US006948927B2

(12) United States Patent
Yang

(10) Patent No.: US 6,948,927 B2
(45) **Date of Patent: *Sep. 27, 2005**

(54) CHILDPROOF SAFETY DISPOSABLE LIGHTER

(76) Inventor: John Jiin Chung Yang, 15443 Proctor Ave., #B, City of Industry, CA (US) 91745

( * ) Notice: Subject to any disclaimer, the term of this patent is extended or adjusted under 35 U.S.C. 154(b) by 0 days.

This patent is subject to a terminal disclaimer.

(21) Appl. No.: 10/866,562

(22) Filed: Jun. 10, 2004

(65) Prior Publication Data

US 2004/0224270 A1 Nov. 11, 2004

Related U.S. Application Data

(62) Division of application No. 10/395,704, filed on Mar. 25, 2003, now abandoned.

(51) Int. Cl.[7] ..... F23Q 25/00

(52) U.S. Cl. ..... 431/151; 431/153; 431/274; 431/276; 431/277

(58) Field of Search ..... 431/151, 153, 431/273, 274, 276, 277

(56) References Cited

U.S. PATENT DOCUMENTS 3,895,904 A * 7/1975 Kimball ..... 431/277

* cited by examiner

*Primary Examiner*—Alfred Basichas
(74) *Attorney, Agent, or Firm*—Raymond Y. Chan; David and Raymond

(57) ABSTRACT

A childproof safety disposable lighter includes a casing, a supporting frame detachably mounted on the casing, an ignition unit which is supported by the supporting frame and includes a striker wheel mounted between two driving wheels, and a pair of safety shells, which are coaxially positioned with the striker wheel and facing two outer sides of the two driving wheels respectively, being integrally, upwardly, and rearwardly extended from two supporting walls of the supporting frame respectively, wherein each of the safety shells is in circular shape having an outer smooth surface and a radius slightly larger than that of the driving wheels so that the two safety shells encircle the outer sides of the two driving wheels respectively to form two physical barriers of the driving wheels.

4 Claims, 3 Drawing Sheets

CHILDPROOF SAFETY DISPOSABLE LIGHTER

CROSS REFERENCE OF RELATED APPLICATION

This application is a Divisional Application of a non-provisional application having an application No. 10/395,704 and a filing data of Mar. 25, 2003 now abandoned.

BACKGROUND OF THE PRESENT INVENTION

1. Field of Invention

The present invention relates to a disposable lighter, more particularly to a childproof safety disposable lighter for preventing under age children from the usage of lighter.

2. Description of Related Arts

Commercially available disposable lighters are dangerous if they are handled carelessly, especially by young children. The inadvertent ignition of such disposable lighters may result in fires causing property damage and injury to people. Therefore, there is a need for a safety device that prevents inadvertent ignition of disposable lighter, or makes the lighters difficult for children to operate. Disposable lighters are now required by federal law to contain ignition safety device in order to prevent young children from igniting the lighters.

In response to the demands for a disposable lighter which is improved in safety in such a manner that inadvertent and unintentional ignition by those who are unfamiliar with the proper use of the lighter can surely be prevented. Childproof disposable lighters having different types of safety devices have already been known. Most of the safety devices built-in with these childproof disposable lighters have a lock mechanism which prevents depression of the actuating lever and must be released to allow the actuating lever to be depressed.

One kind of disposable lighter contains a safety device having an auto lock mechanism wherein a lock member automatically returns to the locked position in response to the ignition operation after the lock member is manually moved to the released position. The operation of such safety device is unreliable because of a probability that the lock member will return to the locked position by its own reactive force due to the resilience of the material constituting the lock member. This adversely affects the ease of releasing the lock mechanism in a lighter, which is generally operated with a single finger, e.g. the thumb, and leads to different operational results depending on the users. Therefore, the conventional safety devices are disadvantageous in practical use.

In view of above, such conventional childproof disposable lighters have drawbacks in practical use, and hence there has been a demand for a childproof safety device which is improved in both safety and operability.

Further, in manufacturing lighters with such safety device, it is required to rationalize the assembling steps, to improve assembling accuracy, thereby further enhancing the handling of the safety device, and to reduce the manufacturing cost.

SUMMARY OF THE PRESENT INVENTION

A main object of the present invention is to provide a childproof safety disposable lighter for preventing under age children from using the lighter without adult's supervision.

Another object of the present invention is to provide a childproof safety disposable lighter, wherein a shielding frame encircles at least a top portion of each of the driving wheels for forming a physical barrier to block the rotation of the driving wheel so as to prevent the childproof safety disposable lighter from being ignited accidentally or by children.

Another object of the present invention is to provide a childproof safety disposable lighter, wherein an ignition unit has an overall thickness less than 7 mm and the childproof safety disposable lighter has an overall thickness less than 9 mm in comparison with a conventional disposable lighter having a thickness within a range of 1.2 mm to 1.8 mm. In other words, the childproof safety disposable lighter of the present invention forms a slim and compact size for easy carriage and storage.

Another object of the present invention is to provide a childproof safety disposable lighter, wherein the ignition unit of the childproof safety disposable lighter can be detached from the supporting frame thereof in such a manner the ignition unit is capable of being replaced when the flint is used up, so as to prolong the service life span of the childproof safety disposable lighter.

Another object of the present invention is to provide a childproof safety disposable lighter, wherein the supporting frame functioning as a windshield has two supporting walls to rotatably mount the driving wheels and the striker wheel therebetween, so as to minimize the component of the childproof safety disposable lighter in comparison with the conventional disposable lighter that the driving wheels and the striker wheel must be rotatably mounted between two wheel supports upwardly extended from the ceiling of the casing.

Another object of the present invention is to provide a childproof safety disposable lighter, wherein the driving wheels are mounted at two outer sides of a striker wheel respectively for driving the striker wheel to rotate for ignition. Therefore, each of the driving wheels forms a second physical barrier to block the rotation of the striker wheel so as to further enhance the resistance of the childproof safety disposable lighter from being ignited accidentally or by children.

Accordingly, in order to accomplish the above objects, the present invention provides a childproof safety disposable lighter, comprising:

a casing having a liquefied gas cavity;

a gas emitting valve having a nozzle upwardly extended from the casing and communicating with the liquefied gas cavity;

an actuating lever for actuating the gas emitting valve to release gas within the liquefied gas cavity;

a supporting frame comprising a U-shaped frame body having two supporting walls parallely extended on top of the casing that the nozzle is upwardly extended between the two supporting walls, the supporting frame further having a flint chamber provided between the two supporting walls;

means for detachably mounting the supporting frame on the casing;

an ignition unit, which is supported by the supporting frame, comprising:

a flint having a bottom portion received in the flint chamber and being supported by a resilient element;

a striker wheel, having a circumferential coarse striking surface in contact with the flint, being rotatably mounted between the two supporting walls; and two driving wheels, each having a diameter larger than that of the striker wheel, mounted at two outer sides of the striker wheel respectively in such a manner that when the two driving wheels rotate, the striker wheel is driven to rotate and strike against the flint to generate sparks directed toward the nozzle of the gas emitting valve; and a pair of safety shells, which are coaxially positioned with the striker wheel and facing two outer sides of the two driving wheels respectively, being integrally, upwardly, and rearwardly extended from the two supporting walls of the frame body respectively, wherein each of the safety shells is in circular shape having an outer smooth surface and a radius slightly larger than that of the driving wheels so that the two safety shells encircle the outer sides of the two driving wheels respectively to form as a physical barrier of the driving wheels.

These and other objectives, features, and advantages of the present invention will become apparent from the following detailed description, the accompanying drawings, and the appended claims.

DETAILED DESCRIPTION OF THE PREFERRED EMBODIMENT

Figure 1:
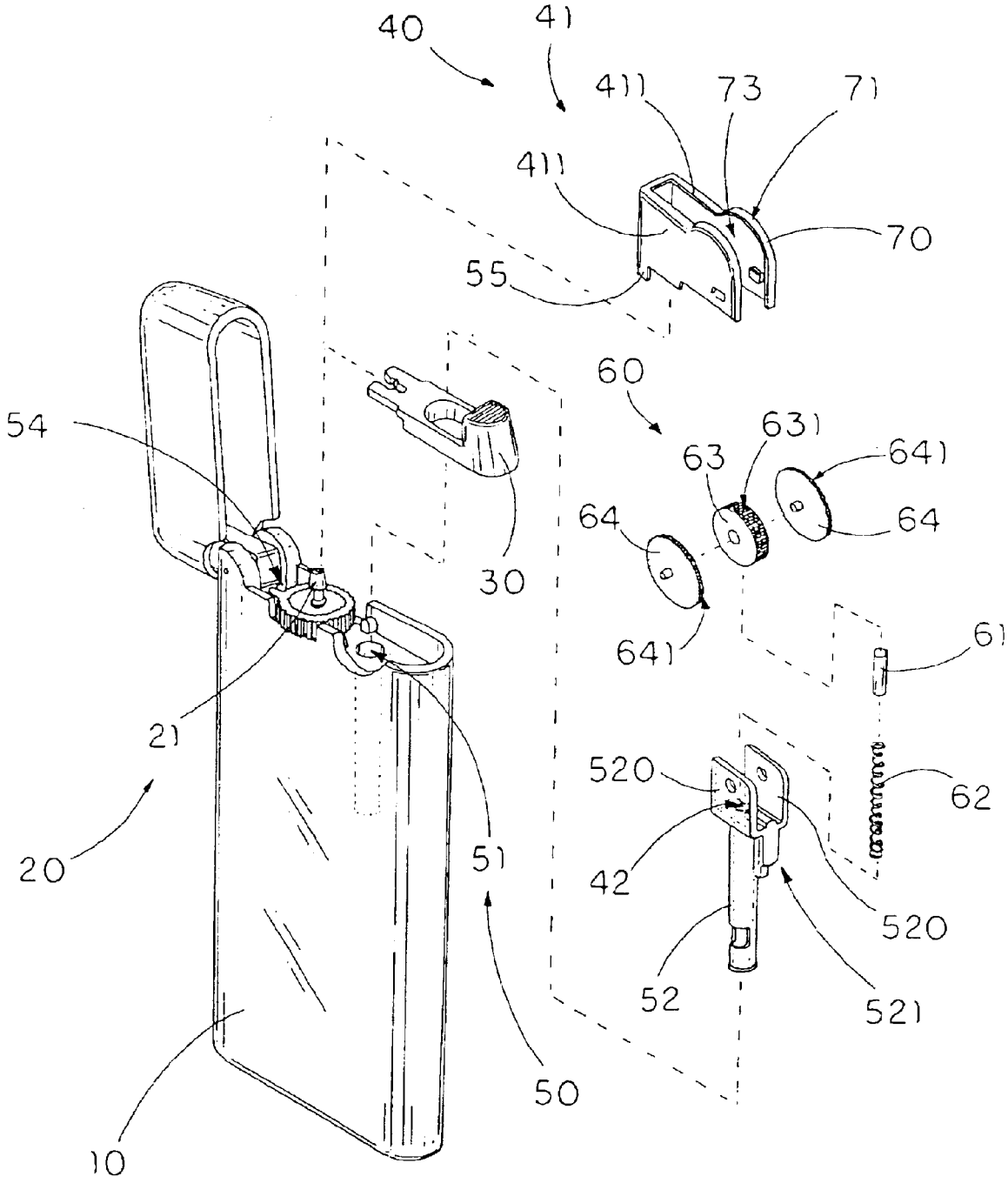
FIG. 1 is an exploded perspective view of a childproof safety disposable lighter according to a preferred embodiment of the present invention.
Figure 2:
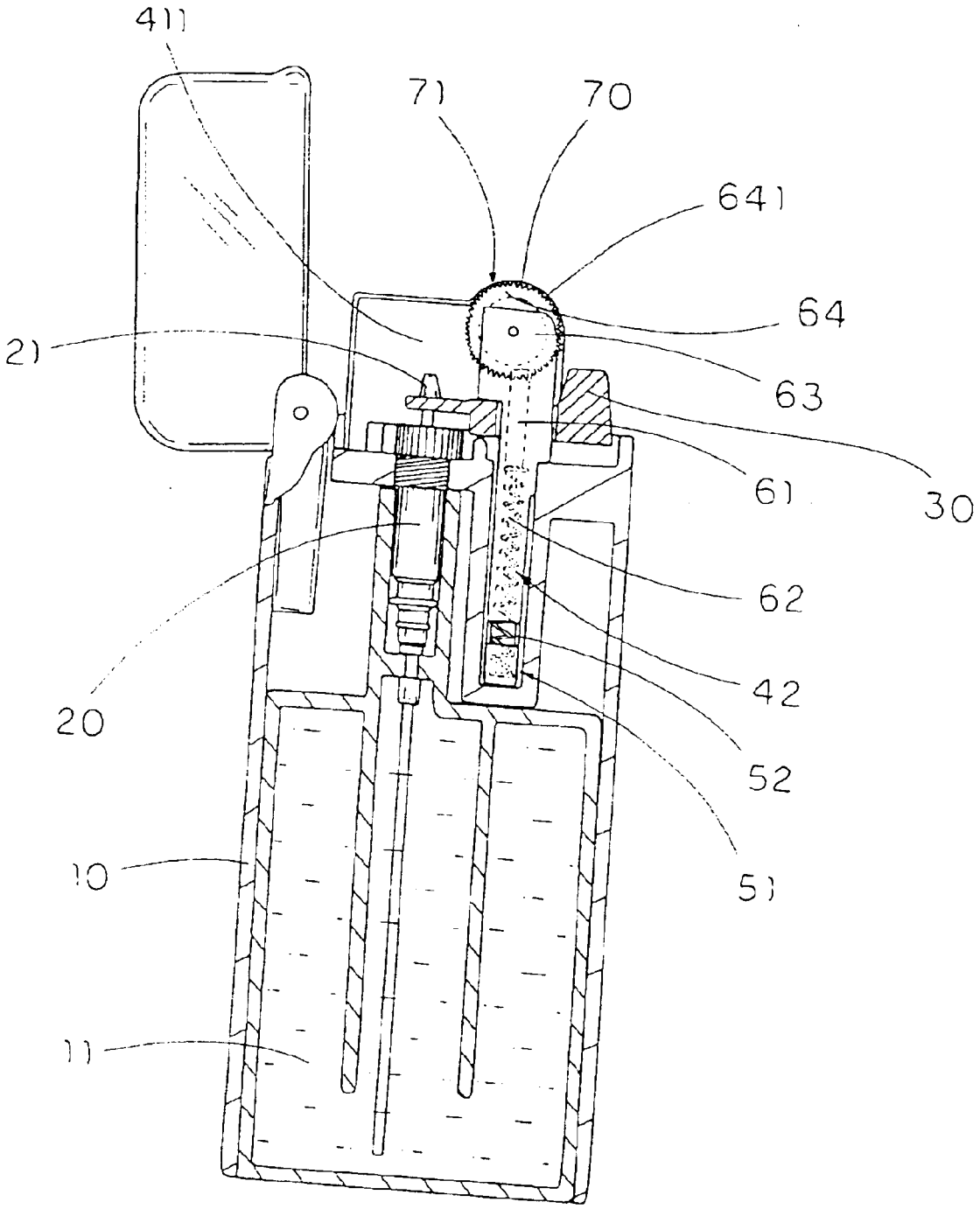
FIG. 2 is a side sectional view of the childproof safety disposable lighter according to the above preferred embodiment of the present invention.
Figure 3:
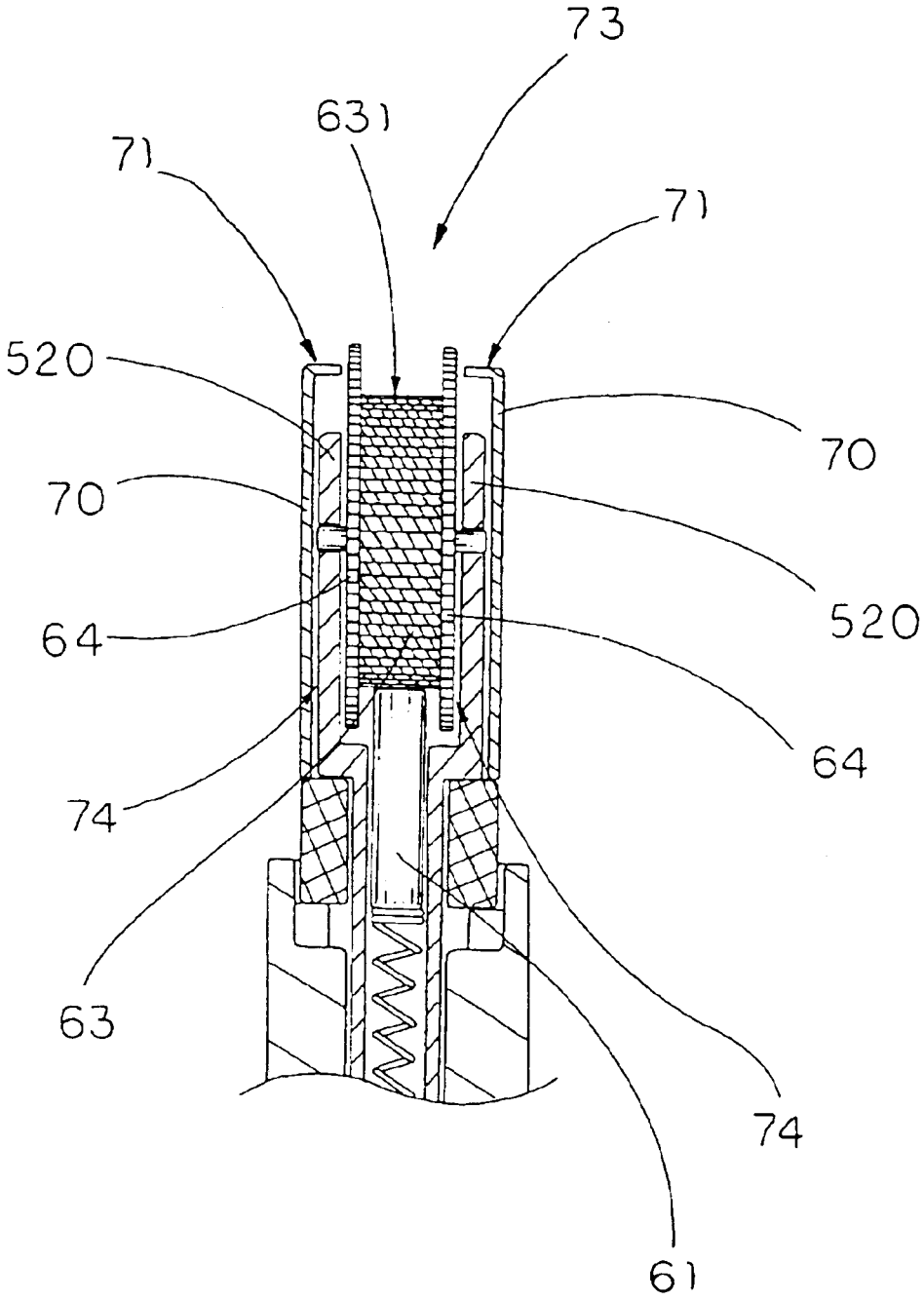
FIG. 3 is a rear view of the childproof safety disposable lighter according to the above preferred embodiment of the present invention.

Referring to FIGS. 1 through 3 of the drawings, a childproof safety disposable lighter according to the preferred embodiment of the present invention is illustrated, wherein the childproof safety disposable lighter comprises a casing 10 having a liquefied gas cavity 11, a gas emitting valve 20 having a nozzle 21 upwardly extended from the casing 10 and communicating with the liquefied gas cavity 11, and an actuating lever 30 for actuating the gas emitting valve 20 to release gas within the liquefied gas cavity 11.

The childproof safety disposable lighter further comprises a supporting frame 40, means 50 for detachably mounting the supporting frame 40 on the casing 10, an ignition unit 60, and a pair of safety shells 70.

The supporting frame 40 comprises a U-shaped frame body 41 having two supporting walls 411 parallely extended on top of the casing 10 wherein the nozzle 21 is upwardly extended between the two supporting walls 411. The supporting frame 40 further has a flint chamber 42 provided between the two supporting walls 411.

The ignition unit 60, which is supported by the supporting frame 40, comprises a flint 61 having a bottom portion received in the flint chamber 42 and being supported by a resilient element 62, a striker wheel 63 having a circumferential coarse striking surface 631 in contact with the flint 61 and being rotatably mounted between the two supporting walls 411, and two driving wheels 64 each having a diameter larger than that of the striker wheel 63, mounted at two outer sides of the striker wheel 63 respectively in such a manner that when the two driving wheels 64 rotate, the striker wheel 63 is driven to rotate and strike against the flint 61 to generate sparks directed toward the nozzle 21 of the gas emitting valve 20.

The safety shells 70, which are coaxially positioned with the striker wheel 63 and facing two outer sides of the two driving wheels 64 respectively, is integrally, upwardly, and rearwardly extended from the two supporting walls 411 of the frame body 41 respectively, wherein each of the safety shells 70 is in circular shape having an outer smooth surface 71 and a radius slightly larger than that of the driving wheels 64 so that the two safety shells 70 encircle the outer sides of the two driving wheels 64 respectively to form two physical barriers of the driving wheels 64 to prevent the user's thumb from engaging with the striker wheel 63.

According to the preferred embodiment, the frame body 41 of the supporting frame 40 is mounted on a ceiling of the casing 10 wherein the nozzle 21 of the gas emitting nozzle 20 is upwardly extended from the ceiling of the casing 10 at a position between the two supporting walls 411 of the frame body 41 such that the frame body 41 of the supporting frame 40 forms a windshield to encircle with the nozzle 21 of the gas emitting nozzle 20.

As shown in FIG. 1, the mounting means 50 has a mounting socket 51 vertically and downwardly extended from the ceiling of the casing 10 and comprises an elongated mounting arm 52 downwardly extended from the supporting frame 40 to slidably insert into the mounting socket 51 so as to detachably mount the supporting frame 40 on the ceiling of the casing 10.

The mounting arm 52 has a guiding portion 521 having a non-circular cross section and an opening of the mounting socket 51 has a corresponding cross section such that when the mounting arm 52 is slidably inserted into the mounting socket 51, the guiding portion 521 of the mounting arm 52 is alignedly positioned at the opening of the mounting socket 51 to retain the supporting frame 40 on the casing 10 in position, so as to prevent an unwanted rotational movement of the mounting arm 52 within the mounting socket 51. Accordingly, an upper portion of the mounting arm 52, having a U-shaped cross section, has two wheel supports 520 wherein the flint chamber 42 is formed between the wheel supports 520 while the striker wheel 63 and the driving wheels 64 are rotatably mounted between the wheel supports 520.

As shown in FIG. 2, the mounting arm 52, having a tubular shape, has an inner cavity defining the flint chamber 42 therewithin in such a manner that the bottom portion of the flint 61 and the resilient element 62 are received in the flint chamber 42 within the mounting arm 52 while a top portion of the flint 61 is upwardly extended from the flint chamber 42.

The mounting means 50 further has a guiding slot 54 indented on the ceiling of the casing 10 and comprises a guiding arm 55 integrally and downwardly extended from a front portion of the supporting frame 40 to slidably insert into the guiding slot 54 so as to further guide the supporting frame 40 to detachably mount on the ceiling of the casing 10.

Accordingly, the flint 61, having a diameter less than 0.18 mm, is slidably disposed in the flint chamber 42 in a vertically movable manner wherein the resilient element 62, according to the preferred embodiment, is a compression spring disposed in the flint chamber 42 for applying an urging force against the flint 61. The compression spring of the resilient element 62 has two ends biased against a bottom side of the flint chamber 42 and a bottom end of the flint 61 respectively so as to push the top portion of the flint 61 above the ceiling of the casing 10.

The striker wheel 63, having a width within a range of 1.8 mm to 2.2 mm, preferably 2.0 mm, is rotatably supported between the two supporting walls 411 wherein the top portion of the flint 61 is frictionally biased against a portion of the circumferential coarse striking surface 631 of the striker wheel 63 in such a manner that when the striker wheel 63 is driven to rotate, the circumferential coarse striking surface 631 of the striker wheel 63 strikes against the flint 61 to produce the sparks towards the nozzle 21 of the gas emitting valve 20.

Each of the driving wheels 64 has a circular disc shape having a thickness within a range of 0.5 mm to 0.7 mm in comparison with a conventional driving wheel having a thickness within a range of 1.2 mm to 1.8 mm. The two driving wheels 64 are supported at the two outer sides of the striker wheel 63 respectively so as to drive the striker wheel 63 to rotate when the driving wheels 64 rotate.

Each of the driving wheels 64 has a plurality of engaging teeth 641 radially and evenly formed at an outer circumferential edge thereof wherein each of the engaging teeth 641 having a tapered shape, has a width gradually reduced from the outer circumferential edge of the driving wheel 61 to form a tapered end.

It is worth to mention that the ignition unit 60 is supported by the supporting frame 40 in such a manner that when the supporting frame 40 is detached from the casing 10, the ignition unit 60 is also taken out from the casing 10. Therefore, once the flint 61 is used up, the user is able to replace a new ignition unit 60 to the casing 10 so as to prolong the service life span of the disposable childproof safety lighter of the present invention. In addition, since different countries require different safety regulations, the manufacturer is able to interchange different safeties of ignition unit 60 by detachably mounting the supporting frame 40 with the ignition unit 60 on the casing 10 without altering the original structural design of the casing 10. Furthermore, the detachably attachment of the ignition unit 60 can minimize the manufacturing cost of the childproof safety disposable lighter incorporating with different kinds of safety mechanism.

Thus, since the striker wheel 63 and the two driving wheels 64 are directly mounted between the two supporting walls 411 of the supporting frame 40 in a rotatably movable manner, the size of the childproof safety disposable lighter can further be reduced to minimize the thickness thereof. It is known that the conventional disposable lighter requires two wheel supports upwardly protruded from the ceiling of the casing to rotatably support the striker wheel 63 and the driving wheels 64, which may substantially increase the overall thickness of the conventional disposable lighter. However, since the conventional wheel supports are substituted by the two supporting walls 411 of the supporting frame 40, the childproof safety disposable lighter of the present invention does not require the conventional wheel supports to support the striker wheel 63 and the driving wheels 64 so that a distance between the two supporting walls 411 of the supporting frame 40 can be substantially reduced to 7.0 mm or less. Therefore, the thickness of the casing 10 can be substantially reduced to 8.0 mm or less to form a slim and compact casing of the childproof safety disposable lighter for easy carriage and storage.

As shown in FIG. 3, each of the safety shells 70, which does not substantially exceed 1.2 mm in thickness, is integrally and rearwardly extended from the respective supporting wall 411 of the frame body 41 to coaxially encircle the respective driving wheel 64.

An ignition cavity 73 is defined between the two safety shells 70 to rotatably receive the driving wheels 64 therein, wherein a gap 74, having a width 1.0 mm or less, is formed between each of the safety shells 70 and each of the driving wheels 64 for receiving the respective wheel support 520 of the mounting arm 52. In other words, each of the wheel supports 520 must not exceed 1.0 mm in thickness.

It is worth to mention that due to the outer smooth surface 71 of each of the safety shells 70, the safety shells 70 can prevent the childproof safety disposable lighter from being ignited unintentionally. Children have already known to rotate the striker wheel 63 of the disposable lighter along a floor or other surface for striking amusing sparks and possibly flames. The outer smooth surface 71 of each of the safety shells 70 will serve to inhibit the generation of sparks and flames when the lighter is abused by children in such a manner. Moreover, for insufficient force, even an adult's thumb will slip off the safety shells 70 without causing the rotation of the striker wheel 63 and operation of the lighter, so as to prevent unintentional ignition.

In order to ignite the childproof safety disposable lighter of the present invention, an adult's thumb must apply sufficient pressure on the safety shells 70 and deform his/her thumb's surface past the safety shells 70 to frictionally engage with the engaging teeth 641 of the driving wheels 64. Therefore, by rotating the driving wheels 64, the striker wheel 63 is driven to rotate to generate the sparks. At the same time, by depressing the depressible rear end of the actuating lever 30, the gas within the liquefied gas cavity 11 releases through the nozzle 21 of the gas emitting nozzle 20 and is ignited by the sparks.

It is worth to mention that if an adult is not intentionally press on the safety shells 70 or a child abuse the lighter, his/her thumb will slip off the outer smooth surfaces 71 of the safety shells 70. It is because his/her thumb is not sufficient pressure to deform past the safety shells 70 in order to engage and rotate the driving wheels 64. In addition, the driving wheels 64 must be driven to rotate in order to rotate the striker wheel 63, such that no actual contact between the striker wheel 63 and the adult's thumb is required. Therefore, the childproof safety disposable lighter of the present invention provides double safety features to prevent people from the misusing of the lighter.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A childproof safety disposable lighter, comprising:

a casing having a liquefied gas cavity;

a gas emitting valve having a nozzle upwardly extended above a ceiling of said casing and communicating with said liquefied gas cavity;

an actuating lever pivotally mounted on said casing to actuate said gas emitting valve for releasing gas within said liquefied gas cavity;

a supporting frame comprising a U-shaped frame body having two supporting walls parallely extended on top of said casing that said nozzle is upwardly extended between said two supporting walls, said supporting frame further having a flint chamber provided between said two supporting walls;

an ignition unit, which is supported by said supporting frame, comprising:

a flint having a bottom portion received in said flint chamber and being supported by a resilient element;

a striker wheel, having a circumferential coarse striking surface in contact with said flint, being rotatably mounted between said two supporting walls; and two driving wheels, each having a diameter larger than that of said striker wheel, mounted at two outer sides of said striker wheel respectively in such a manner that when said two driving wheels rotate, said striker wheel is driven to rotate and strike against the flint to generate sparks directed toward said nozzle of the gas emitting valve; and a pair of safety shells, which are coaxially positioned with said striker wheel and facing two outer sides of the said driving wheels respectively, being integrally, upwardly, and rearwardly extended from said two supporting walls of said frame body respectively, wherein each of said safety shells is in circular shape having an outer smooth surface and a radius slightly larger than that of said driving wheels so that said two safety shells encircle said outer sides of said two driving wheels respectively to farm two physical barriers of said driving wheels; and means for detachably mounting said supporting frame on said ceiling of said casing, wherein said mounting means has a mounting socket downwardly extended from said ceiling of said casing and comprises an elongated mounting arm downwardly extended from said supporting frame to slidably insert into said mounting socket such that said ignition unit is detachably mounted on said ceiling of said casing and is adapted to be replaced when said flint is used up, wherein said mounting arm has a guiding portion having a non-circular cross section and an opening of said mounting socket has a corresponding cross section such that when said mounting arm is slidably inserted into said mounting socket, said guiding portion of said mounting arm is alignedly positioned at said opening of said mounting socket to retain said supporting frame on said casing in position.

2. A childproof safety disposable lighter, comprising:

a casing having a liquefied gas cavity;

a gas emitting valve having a nozzle upwardly extended above a ceiling of said casing and communicating with said liquefied gas cavity;

an actuating lever pivotally mounted on said casing to actuate said gas emitting valve for releasing gas within said liquefied gas cavity;

a supporting frame comprising a U-shaped frame body having two supporting walls parallely extended on top of said casing that said nozzle is upwardly extended between said two supporting walls, said supporting frame further having a flint chamber provided between said two supporting walls;

an ignition unit, which is supported by said supporting frame, comprising:

a flint having a bottom portion received in said flint chamber and being supported by a resilient element;

a striker wheel, having a circumferential coarse striking surface In contact with said flint, being rotatably mounted between said two supporting walls; and two driving wheels, each having a diameter larger than that of said striker wheel, mounted at two outer sides of said striker wheel respectively in such a manner that when said two driving wheels rotate, said striker wheel is driven to rotate and strike against the flint to generate sparks directed toward said nozzle of the gas emitting valve; and a pair of safety shells, which are coaxially positioned with said striker wheel and facing two outer sides of the said driving wheels respectively, being integrally, upwardly, and rearwardly extended from said two supporting walls of said frame body respectively, wherein each of said safety shells is in circular shape having an outer smooth surface and a radius slightly larger than that of said driving wheels so that said two safety shells encircle said outer sides of said two driving wheels respectively to form two physical barriers of said driving wheels; and means for detachably mounting said supporting frame on said ceiling of said casing, wherein said mounting means has a mounting socket downwardly extended from said ceiling of said casing and comprises an elongated mounting arm downwardly extended from said supporting frame to slidably insert into said mounting socket such that said ignition unit is detachably mounted on said ceiling of said casing and is adapted to be replaced when said flint is used up, wherein said mounting arm having a tubular shape, has an inner cavity to define said flint chamber therewithin in such a manner that said bottom portion of said flint and said resilient element are received in said flint chamber within said mounting arm, wherein said mounting arm has a guiding portion having a non-circular cross section and an opening of said mounting socket has a corresponding cross section such that when said mounting arm is slidably inserted into said mounting socket, said guiding portion of said mounting arm is alignedly positioned at said opening of said mounting socket to retain said supporting frame on said casing in position.

3. A childproof safety disposable lighter, comprising:

a casing having a liquefied gas cavity;

a gas emitting valve having a nozzle upwardly extended above a ceiling of said casing and communicating with said liquefied gas cavity;

an actuating lever pivotally mounted on said casing to actuate said gas emitting valve for releasing gas within said liquefied gas cavity;

a supporting frame comprising a U-shaped frame body having two supporting walls parallely extended on top of said casing that said nozzle is upwardly extended between said two supporting walls, said supporting frame further having a flint chamber provided between said two supporting walls;

an ignition unit, which is supported by said supporting frame, comprising:

a flint having a bottom portion received in said flint chamber and being supported by a resilient element;

a striker wheel, having a circumferential coarse striking surface in contact with said flint, being rotatably mounted between said two supporting walls; and two driving wheels, each having a diameter larger than that of said striker wheel, mounted at two outer sides of said striker wheel respectively in such a manner that when said two driving wheels rotate, said striker wheel is driven to rotate and strike against the flint to generate sparks directed toward said nozzle of the gas emitting valve; and a pair of safety shells, which are coaxially positioned with said striker wheel and facing two outer sides of the said driving wheels respectively, being integrally, upwardly, and rearwardly extended from said two supporting walls of said frame body respectively, wherein each of said safety shells is in circular shape having an outer smooth surface and a radius slightly larger than that of said driving wheels so that said two safety shells encircle said outer sides of said two driving wheels respectively to form two physical barriers of said driving wheels; and means for detachably mounting said supporting frame on said ceiling of said casing, wherein said mounting means has a mounting socket downwardly extended from said ceiling of said casing and comprises an elongated mounting arm downwardly extended from said supporting frame to slidably insert into said mounting socket such that said ignition unit is detachably mounted on said ceiling of said casing and is adapted to be replaced when said flint is used up, wherein said mounting means further has a guiding slot indented on said ceiling of said casing and comprises a guiding arm integrally and downwardly extended from a front portion of said supporting frame to slidably insert into said guiding slot so as to further guide the supporting frame to detachably mount on said ceiling of said casing.

4. A childproof safety disposable lighter, comprising:

a casing having a liquefied gas cavity;

a gas emitting valve having a nozzle upwardly extended above a ceiling of said casing and communicating with said liquefied gas cavity;

an actuating lever pivotally mounted on said casing to actuate said gas emitting valve for releasing gas within said liquefied gas cavity;

a supporting frame comprising a U-shaped frame body having two supporting walls parallely extended on top of said casing that said nozzle is upwardly extended between said two supporting walls, said supporting frame further having a flint chamber provided between said two supporting walls;

an ignition unit, which is supported by said supporting frame, comprising:

a flint having a bottom portion received in said flint chamber and being supported by a resilient element;

a striker wheel, having a circumferential coarse striking surface in contact with said flint, being rotatably mounted between said two supporting walls; and two driving wheels, each having a diameter larger than that of said striker wheel, mounted at two outer sides of said striker wheel respectively in such a manner that when said two driving wheels rotate, said striker wheel is driven to rotate and strike against the flint to generate sparks directed toward said nozzle of the gas emitting valve; and a pair of safety shells, which are coaxially positioned with said striker wheel and facing two outer sides of the said driving wheels respectively, being integrally, upwardly, and rearwardly extended from said two supporting walls of said frame body respectively, wherein each of said safety shells is in circular shape having an outer smooth surface and a radius slightly larger than that of said driving wheels so that said two safety shells encircle said outer sides of said two driving wheels respectively to form two physical barriers of said driving wheels; and means for detachably mounting said supporting frame on said ceiling of said casing, wherein said mounting means has a mounting socket downwardly extended from said ceiling of said casing and comprises an elongated mounting arm downwardly extended from said supporting frame to slidably insert into said mounting socket such that said ignition unit is detachably mounted on said ceiling of said casing and is adapted to be replaced when said flint is used up, wherein said mounting arm having a tubular shape, has an inner cavity to define said flint chamber therewithin in such a manner that said bottom portion of said flint and said resilient element are received in said flint chamber within said mounting arm, wherein said mounting means further has a guiding slot indented on said ceiling of said casing and comprises a guiding arm integrally and downwardly extended from a front portion of said supporting frame to slidably insert into said guiding slot so as to further guide the supporting frame to detachably mount on said ceiling of said casing.

* * * * *